US005884841A

United States Patent [19]

Ratnik et al.

[11] Patent Number: 5,884,841

[45] Date of Patent: Mar. 23, 1999

[54] METHOD AND APPARATUS FOR MAKING SNOW

[75] Inventors: H. Ronald Ratnik, Pittsford; Louis N. Rapp, Dansville; Timothy C.Y. Wang, Rochester, all of N.Y.

[73] Assignee: Ratnik Industries, Inc., Victor, N.Y.

[21] Appl. No.: 845,760

[22] Filed: Apr. 25, 1997

[51] Int. Cl.[6] ..... F25C 3/04

[52] U.S. Cl. ..... 239/2.2; 239/14.2; 239/418

[58] Field of Search ..... 239/2.2, 14.2, 239/418

[56] References Cited

U.S. PATENT DOCUMENTS

| | | | |
|---|---|---|---|
| 3,822,825 | 7/1974 | Dupre | 239/14.2 |
| 3,945,567 | 3/1976 | Rambach | 239/14.2 |
| 3,979,061 | 9/1976 | Kircher | 239/14.2 X |
| 4,105,161 | 8/1978 | Kircher et al. | 239/2.2 |
| 5,004,151 | 4/1991 | Dupre | 239/14.2 |
| 5,699,961 | 12/1997 | Ratnik et al. | 239/14.2 |

*Primary Examiner*—Andres Kashnikow
*Assistant Examiner*—Robin D. Evans
*Attorney, Agent, or Firm*—Warren W. Kurz

[57] ABSTRACT

Snow-making apparatus comprises the combination of a bulk water nozzle for projecting a spray of water particles into the air, and a plurality of nucleators for injecting ice particles (nuclei) into the spray to provide nucleation sites about the water particles freeze and form snow particles or crystals. Each nucleator comprises discrete nozzles for respectively projecting air and water particles to a location at which they collide in the open air to form ice particles. Because the ice particles are formed "externally" of any housing, the "freeze-up" problem associated with the "internal-mix" nucleators of the prior art is avoided. Preferably, each of the water nozzles of the external mix nucleators projects a relatively thin "sheet" of water which collides with a similar pattern of compressed air which acts (a) to break-up the water into relatively tiny droplets (e.g. 5–100 microns in size) which quickly freeze to form the ice nuclei of about the same size, and (b) to project a relatively flat pattern of ice nuclei towards the bulk water spray.

16 Claims, 6 Drawing Sheets

METHOD AND APPARATUS FOR MAKING SNOW

BACKGROUND OF THE INVENTION

1. Field of the Invention

The present invention relates to improvements in methods and apparatus for making man-made snow. More particularly, it relates to a snow-making apparatus and method in which "external mix" nucleators are used to inject tiny ice particles or "nuclei" into a fine spray of water to convert the water particles to snow particles or crystals before descending to earth.

2. Discussion of the Prior Art

Many different types of apparatus have been devised and used for producing "man-made" snow. Typically, such apparatus is found at ski resorts and operates to supplement the supply of natural snow on ski trails and surrounding areas. Virtually all types of snow-making devices produce snow by projecting water droplets into a stream of cold air, the latter serving to cool the droplets to a temperature at which they convert to ice crystals before descending to the ground. Some devices, known as "fan guns," employ a large motor-driven fan for creating the cooling air stream. In other devices, known as "snow canons" or "snow guns", the air stream is provided by a source of compressed air. The cooling air stream acts to enhance the water-to-snow conversion efficiency of the device by (a) creating a turbulent air flow which assists in both the droplet cooling and mixing processes, and (b) lengthening the droplet flight time or "hang time", thereby giving the droplets more time to cool and crystallize before reaching the ground.

In U.S. Pat. No. 4,711,395 issued to Louis Handfield, there is disclosed a fan gun of the type mentioned above. This fan gun is of the "central nozzle" variety in that the water droplets are introduced into the fan-produced air stream by a water nozzle located along the central axis of a barrel-shaped fan housing through which the air stream is propelled by the motor-driven fan. The water nozzle disclosed in this patent is of the type used on the hoses of fire-fighting equipment. Its output is adjustable to provide a desired throughput and spray pattern, and it includes spinning turbine teeth which act to break up the water supplied thereto into droplets of a "size ideal for snow-making". In the art, this phrase is understood to mean that the droplets are about 500–1000 microns in size because, in the case of a water nozzle of the type disclosed, i.e., the "Turbojet" (trademark) nozzle made by Akron Brass Company, the nozzle is not capable of breaking up the discharged water into droplets or particles any finer. To facilitate the conversion of such water droplets to ice crystals by the fan-produced air stream, a plurality of "nucleators" are arranged about the water nozzle and within the barrel-shaped fan housing. Each of the nucleators comprises a nozzle connected to a source of water. The nucleator nozzles act to atomize the water provided thereto to produce tiny water particles (e.g. 10 microns in size) called "nuclei," and to inject such water nuclei into the swirling water/air mixture provided by the water nozzle and fan combination. Owing to their small size, the nuclei freeze first and thereby act as seeds for the further formation of ice crystals in the water/air mixture.

Depending on ambient conditions, most commercially available fan guns are advantageous in that they are capable of converting relatively large volumes of water to snow per unit time. For example, at a temperature of about 15 degrees F. (−9 degrees C.), most fan guns are capable of converting between 75 and 100 gallons of water per minute to snow. But fan guns are generally considered disadvantageous from the standpoints of cost and size. More specifically, they are costly to manufacture and, owing to the motorized fan component, require considerable electrical power to operate. Also, due to their physically large size (typically, between 18 and 36 inches in diameter and having a weight of between 1000 and 2000 lbs.), fan guns tend to be difficult to manipulate in order to produce snow where desired, e.g., along narrow ski trails and other difficult to reach places. Further, owing to their large size, they are awkward, at best, to support, manipulate and operate at elevated positions, such as on towers or the like. This is especially true in windy conditions. As indicated above, placement of any snow-making device at an elevated position, and in particular more than about 15 feet above ground level, has a dramatic effect on the water-to-snow conversion efficiency of the device owing to the increase in droplet flight time and, hence, the cooling time of the droplets.

There are many smaller and less costly alternatives to the fan guns discussed above, including the air/water snow guns disclosed in the commonly assigned U.S. Pat. No. 3,829,013 issued to H. R. Ratnik, and in U.S. Pat. No. 4,199,103 issued to H. K. Dupre. Rather than employing a motorized fan to effect droplet cooling, both of these snow guns use a source of compressed air to cool the droplets. In the Ratnik device, water droplets are formed in an enclosed housing before being propelled into the atmosphere by the compressed air. In the Dupre snow gun, a stream of water is sprayed into the atmosphere and a jet of compressed air, located downstream of the water spray, is used to both break up the water into small particles and convert such particles to ice crystals. While being considerably less expensive to manufacture and operate, these snow guns are generally incapable of producing the volume of snow provided by fan guns.

In the commonly assigned International Patent Application No. WO 96/35087, published on 7 Nov. 1996 in the names of H. R. Ratnik and T. C. Wang, there is disclosed a fanless snow gun which minimizes many of the above-noted problems. This snow gun comprises the combination of one or more bulk water nozzles for projecting a relatively fine spray of water particles into the air, each of the particles having an average size smaller than about 300 microns; and a plurality (e.g., from 2 to 6) of nucleating nozzles which are radially spaced about the water nozzle for injecting ice particles or "ice nuclei" into the spray of water particles to provide nucleation centers about which the water particles freeze and form ice crystals. Preferably, the snow gun is supported by a tower high above ground level (e.g., 6 to 9 meters above) to enable sufficient flight time for all of the water particles in the spray to collide with the ice nuclei and thereby freeze into snow crystals before reaching the ground. Each of the nucleating nozzles comprises a housing in which water and compressed air are internally mixed to produce the ice nuclei. As noted in this publication, each of the nucleating nozzles optionally includes an internal electric heating coil which serves to prevent the nucleator nozzle from "freezing up" at ambient temperatures below freezing. This freezing up is apt to occur each time the nucleator is shut off as residual water trapped in the nozzle contacts the cold air within the housing. In sufficiently cold ambient conditions, freezing can occur even when the nucleator is operating. As a practical matter, such heaters are always required in snow guns of this type to assure that snow can be made at virtually any temperature below freezing. Thus, the need for such heaters in such "internal mix" nucleators adds manufacturing costs to the product and should be avoided if possible. Moreover, the need for heaters imposes a requirement for electrical power to be available at each snow-making site. A further disadvantage of such "internal mix" nucleators is that, if the water pressure applied to the nucleator housing rises above a certain level, the water pressure within the housing can choke or interrupt the air flow, thereby causing the production of nuclei to stop or be intermittent. In typical ski areas where such snow-making equipment is most often used, it is not uncommon to experience the type of water pressure changes that give rise to this effect.

SUMMARY OF THE INVENTION

In view of the foregoing discussion, an object of this invention is to provide an improved apparatus for making man-made snow, one which affords all of the advantages associated with the fanless snow gun described in the aforementioned International Application, but one which requires no auxiliary electric heaters to assure that snow can be made at all temperatures below freezing.

Another object of this invention is to provide an improved method for making snow, one which can provide the same volume of snow at lower cost in terms of energy consumption.

Like the prior art, the fanless snow gun of the invention comprises the combination of a bulk water nozzle for projecting a spray of water particles into the air, each of said particles being of relatively small size, i.e., a size of less than about 300 microns; and a plurality of nucleators for injecting ice particles into the spray to provide nucleation sites about the water particles freeze and form ice crystals. But, unlike the prior art, each of the nucleators comprising the snow-making apparatus of the invention is an "external mix nucleator," the likes of which are unknown in conventional snow-making equipment, including those that use motorized fans, i.e., fan guns. The phrase "external mix nucleator" refers to a nucleator that mixes compressed air and water in the open atmosphere in such amounts as to produce ice nuclei, in contrast with conventional nucleators that produce ice nuclei by mixing compressed air and water within a housing to which the air and water are supplied and projecting such nuclei through a common nozzle supported by the housing. Thus, the external mix nucleators used in the apparatus of the invention comprise discrete nozzles for projecting air and water particles to a location at which they mix in the ambient air and form ice particles. Because the ice particles are formed "externally" of any housing which contains both air and water, the aforementioned "freeze-up problem is eliminated. Preferably, each of the water nozzles of the external mix nucleators projects a relatively thin "sheet" of water which, before any substantial droplet formation occurs in the ambient air, is intercepted by a similar pattern (i.e. a sheet) of compressed air which acts (a) to break-up the water into relatively tiny droplets (e.g. 5–100 microns in size) which quickly freeze to form ice nuclei of about the same size, and (b) to project the ice towards the bulk water spray. Due to a reduced pressure in the vicinity of the bulk water spray, the ice nuclei are drawn into the water spray and used to initiate the ice crystal formation process within the bulk water spray.

The improved method for making snow basically comprising the steps of: (i) projecting a bulk spray of water droplets into the ambient air; (ii) producing ice nuclei by causing respective sprays of water and air to collide in the open ambient air in the vicinity of said bulk spray; and (iii) injecting said ice nuclei into said bulk spray of water to provide nucleation sites about which said water droplets can freeze. Preferably, the ice nuclei are produced by causing fan-shaped sprays of air and water to converge in the open air.

The invention will be better understood from the ensuing detailed description of preferred embodiments, reference being made to the accompanying drawings in which like reference characters denote like parts.

DETAILED DESCRIPTION OF PREFERRED EMBODIMENTS

Figure 1:
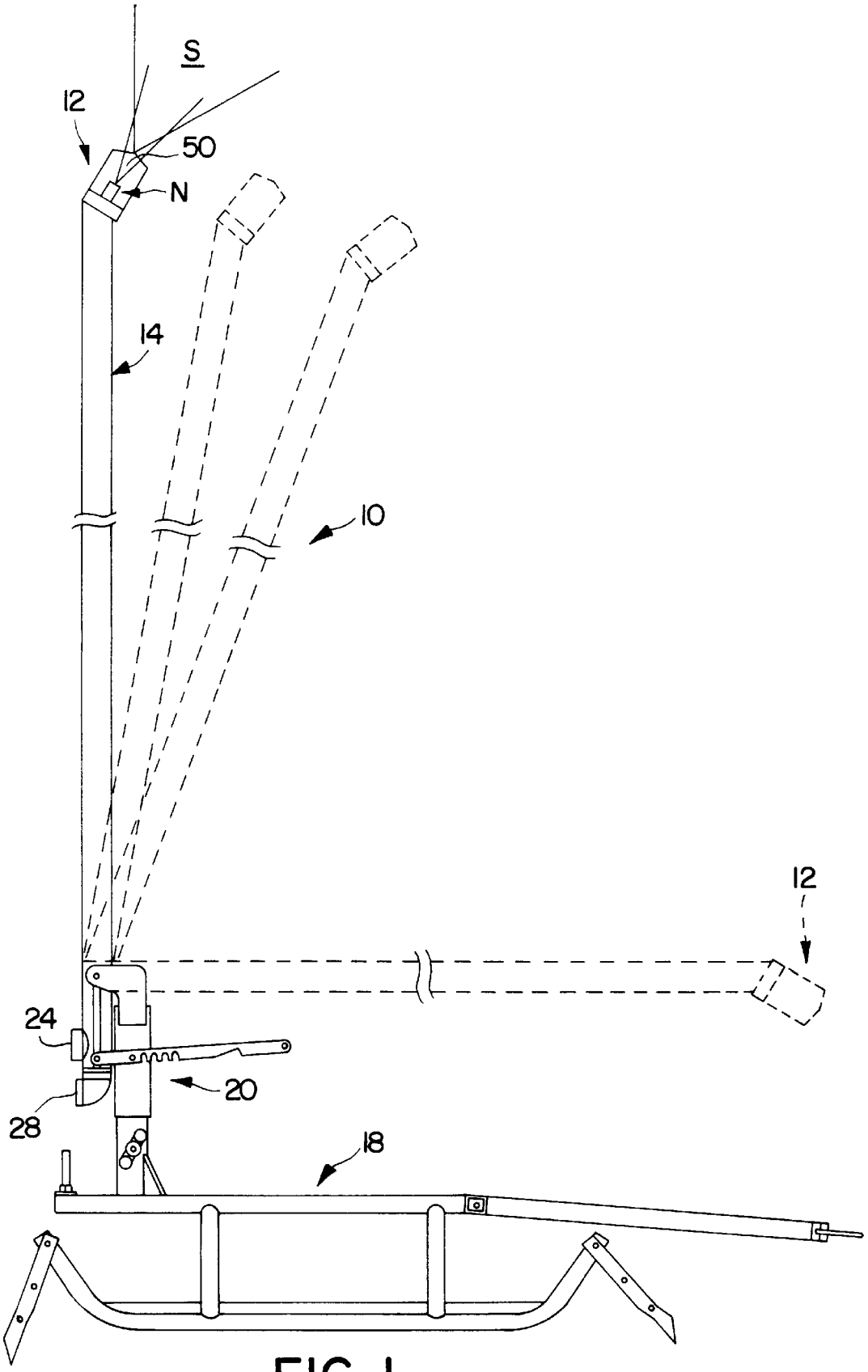
FIG. 1 is a side elevation of a preferred embodiment of the invention showing a tower-mounted fan-less snow gun.

Referring now to the drawings, FIG. 1 illustrates snow-making apparatus 10 in which the new and improved snow-gun 12 of the invention is shown to be mounted on one end of an elongated boom 14. The latter is pivotally mounted on a yoke 16, supported by a snow sled 18, for movement between a horizontal storage position, and any one of a plurality of different upright operating positions in which the snow gun is supported several meters (e.g., 3 to 6 meters) above ground level, depending on the boom length and the boom angle relative to horizontal. A suitable mechanism 20 is provided for selectively locking the boom in different operating positions. Preferably, boom 14 comprises a hollow, light-weight metal tube 22, preferably made of aluminum, having a suitable fitting 24 supported by the tube wall which is connectable to a source of water, preferably having a pressure of between 250 and 600 PSI. Thus, in addition to functioning to support the snow gun in an elevated position, boom 14 serves as a conduit for transporting water from ground level to the elevated snow gun. Located within boom 14 is a second tube or conduit 26 (shown in FIG. 5) which serves to convey compressed air to the snow gun. A suitable fitting 28 connected to the end of tube 22 and connected to conduit 26, is connectable to a source of compressed air of about 90 PSI. When the compressed air and water sources are applied to the snow gun, a spray S of ice crystals is produced, as explained below.

Referring to FIGS. 2–6, a preferred snow gun 12 of the invention is of the "fan-less" variety (e.g., similar to that disclosed in the aforementioned International Patent Application). Snow gun 12 comprises a housing 30 which supports a relatively large bulk water nozzle 32, and a plurality of smaller nozzles 34 and 36 which, as explained below, cooperate in producing the ice nuclei required for enhancing the snow-making efficiency of the snow gun. The walls of housing 30 defines two discrete chambers, a water chamber 38 connected to the water-containing portion of boom 14, and an air chamber 40 connected to the compressed air-containing conduit 26 within boom 14. Bulk water nozzle 32 is connected to a quick-disconnect fitting extending from the forwardmost end of water chamber 38. The function of the bulk water nozzle is to convert the water provided to chamber 38 to a relatively large throughput, e.g., 20 to 120 gallons per minute, spray of water particles which become "supercooled" within a short distance from the nozzle and are of a size that renders them readily convertible to ice crystals upon interacting with a nucleation center, e.g., a small particle of ice. Note, a larger throughput of bulk water can be achieved by using more than one nozzle, as disclosed below with reference to FIG. 7. Preferably, nozzle 32 is structured to produce a fine, conically-shaped spray of water particles having a cone angle of between about 40 and 50 degrees. The average size of the water particles of the bulk water spray should be no greater than 400 microns, and more preferably, not greater than about 300 microns. A preferred bulk water nozzle is the FOGJET (trademark) Spray Nozzle made by Spraying Systems Co., Wheaton, Ill, USA. Nozzle.

To provide the bulk water spray with the aforementioned nucleation centers (ice particles) required to enhance the snow-making process, snow gun 12 comprises one or more (preferably from 2 to 8) "external" nucleators N, each comprising a water nozzle 34 and an air nozzle 36. The function of nucleators N is to produce, in the ambient atmosphere surrounding the bulk water nozzle, relatively small ice particles, 5 to 100 microns in size, which are useful as nucleation centers, and to project such particles to a location at which they will be drawn into the bulk water spray. Ideally, the number of nuclei produced should be sufficient to convert all water droplets to ice crystals before the water droplets reach the ground. This depends, of course, on atmospheric conditions, bulk water particle size, air and water velocities, etc. Typically, however, each nucleator should produce between $1\times10^9$ and $1\times10^{12}$ particles per minute. Towards this end, the nucleator water nozzles 34 are threaded into a water chamber-defining side wall 30*a* of housing 30 so as to be supplied with water from the common water source provided through tube 22, and are arranged to such that their respective longitudinal axes are at an angle of about 60 degrees relative to the axis A of bulk water nozzle 32. It is highly preferred that water nozzles 34 be designed to provide a substantially flat, fan-shaped pattern of water of relatively low throughput compared to the bulk water nozzle, e.g., between about 0.2 and 1.0 gallon per minute. The nucleator air/water ratio, in terms of cubic feet per minute to gallons per minute, is typically greater than 20:1, compared to total air-to-water ratio of a high efficiency snow gun of less than 5:1. Each water nozzle is preferably provided with a mesh screen 34*a* to prevent dirt particles in the water supply from clogging the relatively tiny output aperture of the water nozzle.

Figure 2:
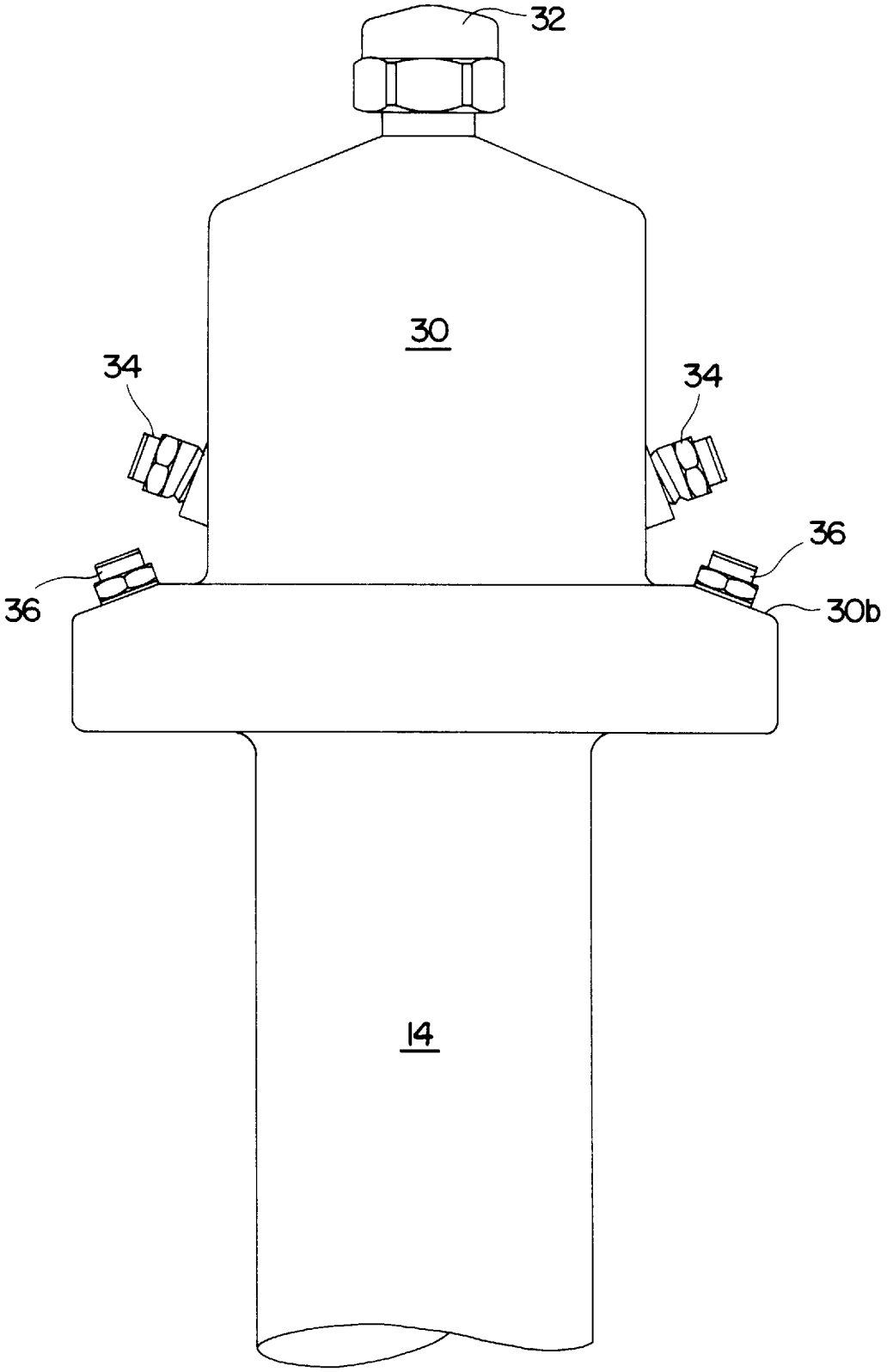
FIG. 2 is a side elevation showing certain structural details of the snow gun shown in FIG. 1.
Figure 3:
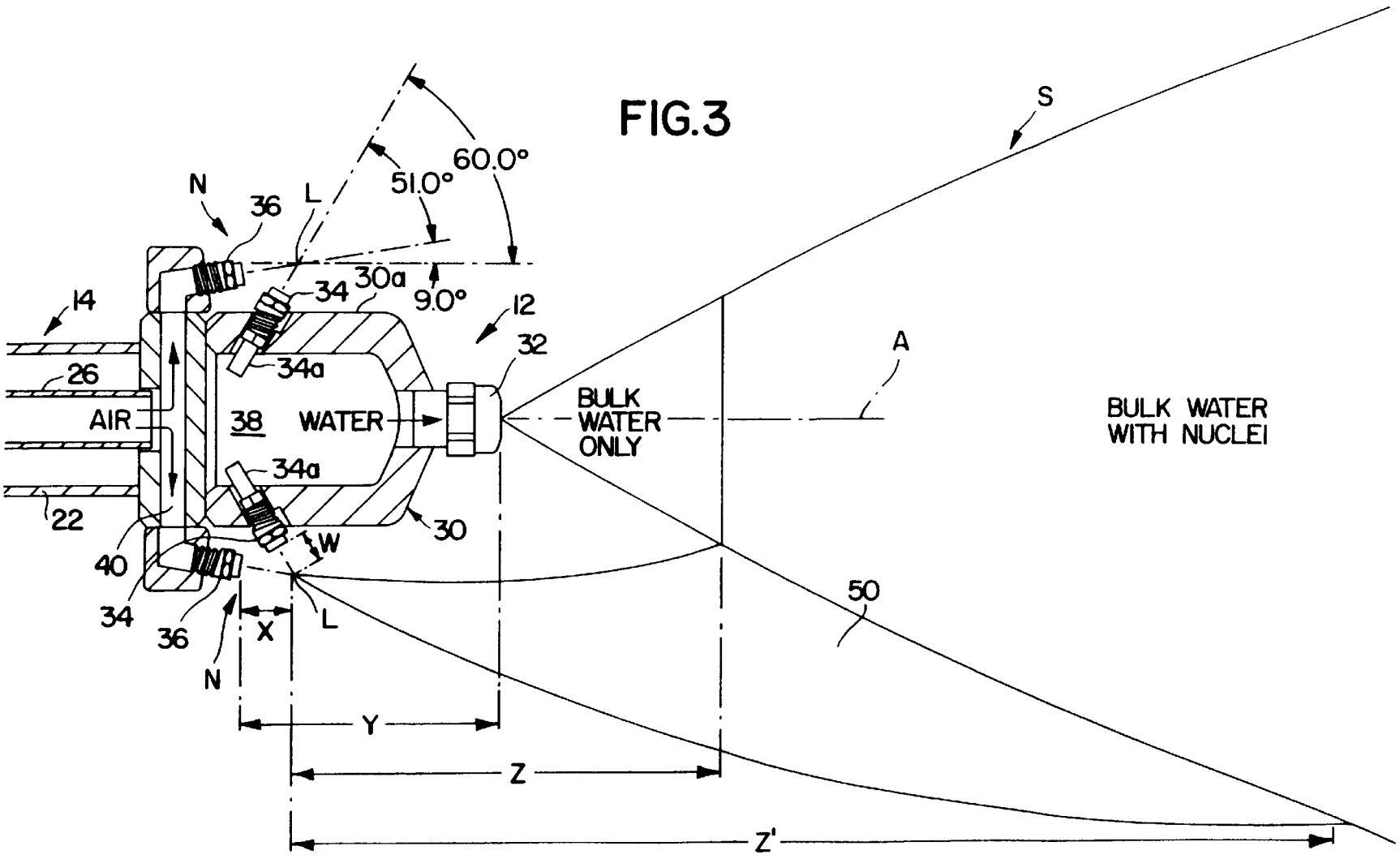
FIGS. 3 and 4 are top and side cross-sectional illustrations, respectively, of the snow gun shown in FIG. 2.
Figure 4:
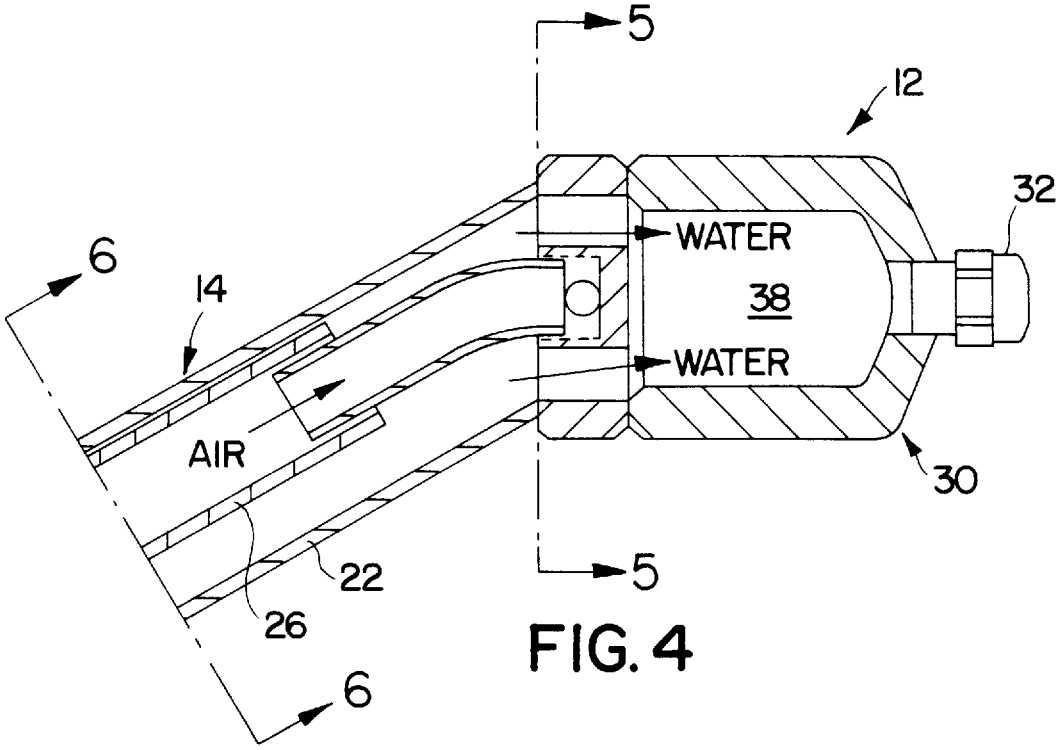
Figure 7:
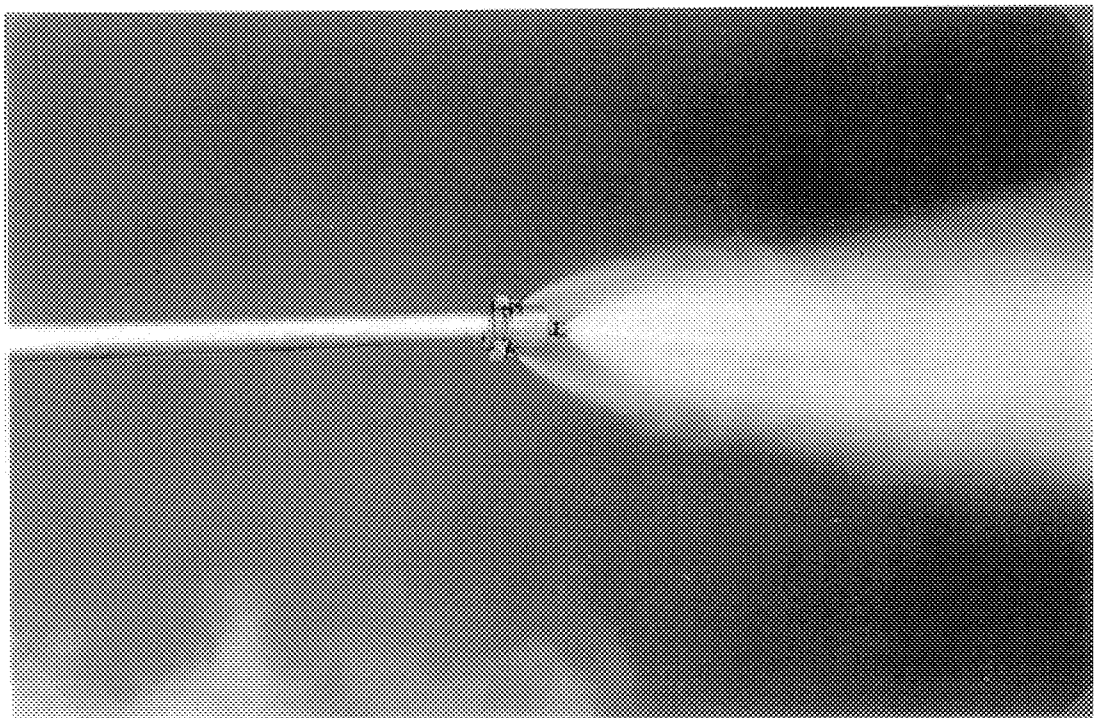
FIG. 7 is a photograph of the FIG. 2 snow gun in operation.

As shown in FIG. 2, the nucleator air nozzles 36 are threaded into a forward-facing wall 30*b* of housing 30, such wall defining part of the air chamber 40. Air nozzles 36 are closely spaced relative to the water nozzles 34, and like the water nozzles, it is preferred that air nozzles 36 provide a flat, fan-shaped pattern of air, the fan angle being about 30 degrees for both water and air nozzles. Preferably, nozzles 34 and 36 should be as close as reasonably possible to have the greatest atomization and cooling effect. Linear distances of greater than 50 mm. are not as effective in terms of atomization, may contribute to icing of the nucleator water nozzle 34 and will not be as tolerant of water and air pressure variations. The angle between the respective outputs of nozzles 34 and 36 should be in the range of 25 to 75 degrees, preferably about 51 degrees. While greater angles have been attempted, they require a greater air/water ratio to effect a change in the nucleator spray trajectory. Angles less than 25 degrees require more air due to the smaller differential velocities of air and water at the collision point and the reduced atomization. Both water and air nozzles 34 and 36 should be of the flat spray variety, as explained below, and exhibit a medium spray angle of about 50 degrees (measured perpendicular to the plane of the drawings) to produce a relatively wide nucleation plume. Preferably, the output of air nozzle 36 completely envelops all nucleating water to prevent "loose water" from forming ice on housing 30. The nucleator nozzles are rotatably positioned within their respective supporting housing walls such that their respective outputs collide along a line L that is perpendicular to the plane of the drawing of FIG. 3. Preferably, the closest collision point along line L to the output of the water nozzle is no more than about 15 mm., i.e., w=15 mm., and the closest collision point along line L to the air nozzle aperture is no more than about 30 mm., i.e., x=30 mm. At such short distances from the air and water nozzle apertures, the sheet of water emerging from nozzles 36 is quickly broken into small water droplets, ranging in size from 5 to 100 microns, which will quickly freeze to form the desired plume of ice nuclei 50. The air nozzles are arranged at an angle of about 9 degrees relative to the bulk water nozzle axis A, and force of the air from the air nozzles will project the plume of ice nuclei generally towards the bulk water spray. Owing to the reduced pressure at the boundaries of the bulk water spray, the ice nuclei is drawn into the water spray (as shown in the photograph of FIG. 7) and used as nucleation centers for converting the bulk water droplets to ice crystals. While the drawings illustrate using only two nucleators on opposite sides of the bulk water nozzle, more than two can be used and, in fact, are preferred in achieving maximum water-to-snow conversion efficiency. When three or more nucleator are used with a bulk water nozzle which produces a conical spray, the nucleators are arranged on a circular pattern, at equal angles therebetween, surrounding the bulk water nozzle. Preferably, the air nozzles are position about 100 to 200 mm. rearward of the bulk water nozzle aperture, i.e., y=100 to 200 mm., which gives rise to the nuclei plume entering the bulk water spray between about 125 and 400 mm. from the bulk water nozzle end, i.e., Z=125 mm., and Z'=about 400 mm.

Figure 5:
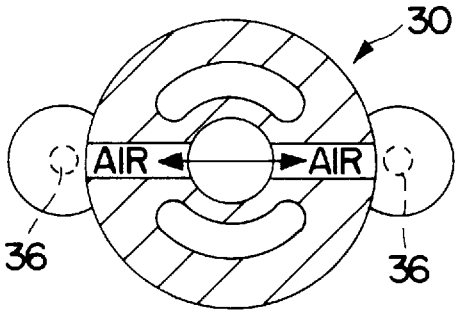
FIGS. 5 and 6 are cross-sectional views of the snow gun shown in FIG. 4 taken along the section lines 4—4 and 5—5, respectively.
Figure 6:
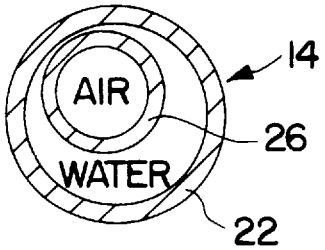

In the cross-sectional illustration of FIG. 5, the structural details of housing 30 which enables compressed air in conduit 26 to be distributed to air nozzles 36 are shown. FIG. 6 illustrates the conduit-within-a-conduit configuration of boom 14.

Figure 8:
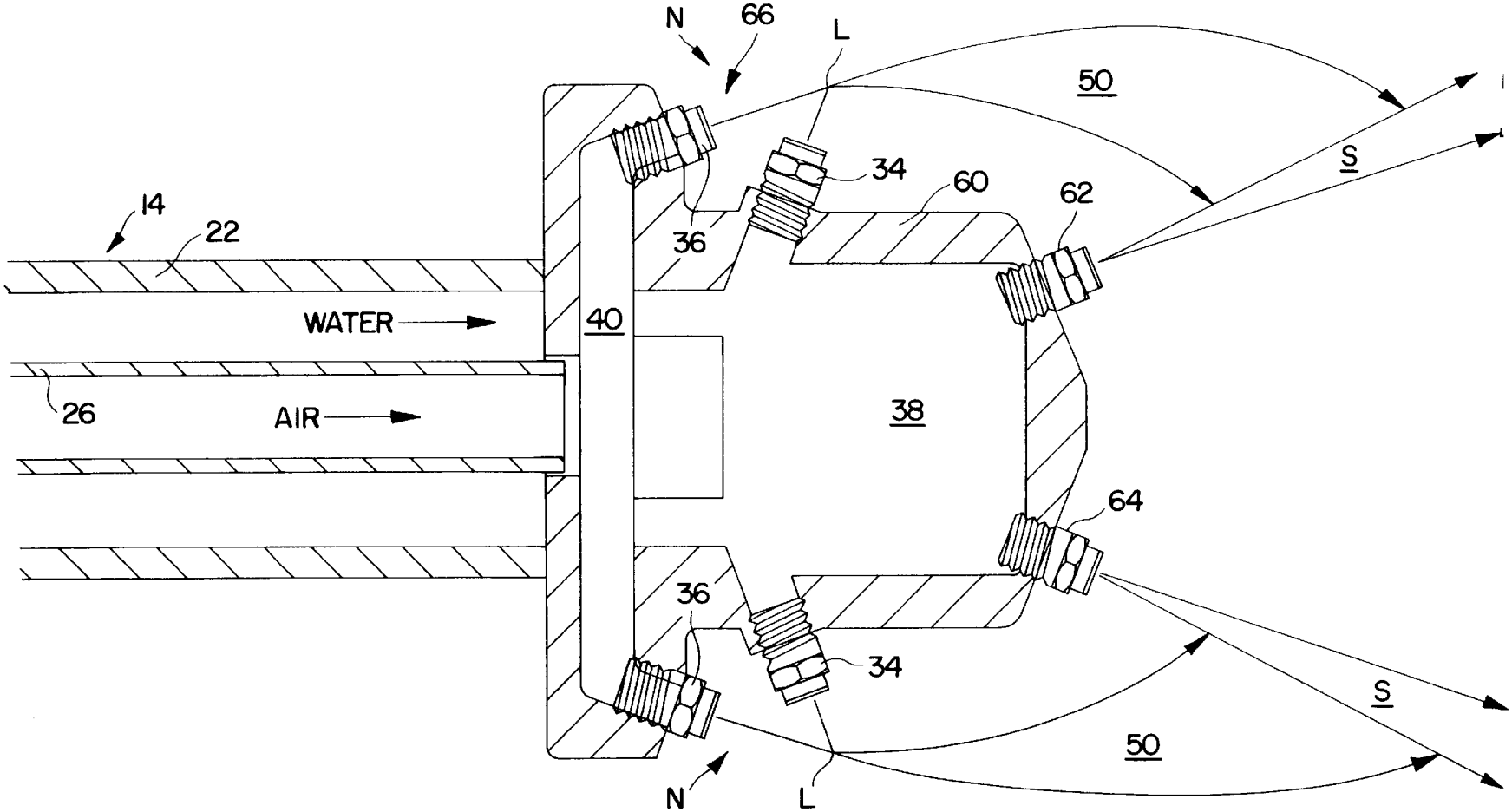
FIG. 8 is a top cross-sectional illustration of another embodiment of the invention.

In FIG. 8, a second preferred embodiment is illustrated in which a snow gun housing 60 supports a plurality (here, two) of bulk water nozzles 62 and 64 which are collectively capable of projecting a larger volume of bulk water than nozzle 32 shown in FIG. 2. Nozzles may be of the type which produce conical sprays of bulk water, or may be flat spray nozzles which are designed and oriented to project a substantially flat spray S' of water particles in a plane perpendicular to the plane of the paper, whereby the respective flat patterns of ice nuclei produced by the nucleators 66 are more efficiently drawn into the bulk water plume. As a result of the production of ice nuclei in the ambient air and external to any housing as is characteristic of prior art nucleators, the above-identified freeze-up problems are solved, and the attendant costs of electrical heaters is eliminated. Another advantage afforded by the external-mix nucleators comprising the snow-making apparatus of the invention is that a greater percentage of ice nuclei act to seed or nucleate the formation of ice particles from the water particles in the bulk water spray. This advantage is believed to arise, at least in part, from the relatively "flat" pattern of ice nuclei resulting from the collision of the flat sprays of water and air emerging from the nucleator nozzles 34 and 36. In the internal-mix nucleators of the prior art, such a flat spray is not easily achieved, and a greater portion of the conical pattern of nuclei produced by most snow guns is not drawn into the bulk water plume and used to spawn freezing of the bulk water particles. This improvement in water-to-ice conversion efficiency allows the same amount of snow to be produced from a tower about 50% lower than the tower used to support the fanless snow gun disclosed in the aforementioned International Patent Application (e.g. a tower only 4 meters high versus 8 meters in the case of the prior art), and allows the same amount of snow to be made at warmer ambient temperatures and/or a dryer snow to be made. The use of a shorter tower is advantageous in that far fewer snow particles are lost to wind drift, and more snow particles are deposited in a desired location, e.g., on the ski trails. Further, the shorter tower is much easier to install and transport.

The invention has been described with reference to preferred embodiments. It will be understood, however, that variations can be made without departing from the spirit of the invention. For example, while the external mix nucleators of the invention have been disclosed as embodied in a fan-less snow gun, it will be appreciated that these nucleators could take the place of the internal mix nucleators employed in any snow-making device, including conventional fan-type snow guns. Thus, such variations are intended to be encompassed by the following claims.

What is claimed is:

1. Snow-making apparatus comprising the combination of (a) a bulk water nozzle connectable to a source of water and being operable to project to spray of water particles into the air, said particles having an average size of less than about 300 microns, and (b) a plurality of dedicated nucleators for injecting ice particles into the spray to provide nucleation sites about said water particles freeze and form snow crystals, each of said nucleators comprising discrete air and water nozzles for respectively projecting air and water particles to a location at which they externally mix in the ambient air and form said ice particles, said air nozzle being arranged relative to said location and said bulk water nozzle to project said ice particles to a location at which said ice particles are drawn into the water particle spray and, thereby serve as sites about which the water particles freeze to produce snow crystals, said water nozzles collectively consuming less than about 5 gallons of water per minute.

2. The apparatus as defined by claim 1 wherein said air and water nozzles of said nucleators respectively produce fan-shaped sprays of air and water which converge along a line positioned at said location.

3. The apparatus as defined by claim 1 wherein said bulk water nozzle and said nucleators are supported by a common housing having discrete air and water compartments to which sources of compressed air and water are respectively connectable.

4. The apparatus as defined by claim 1 wherein the closest point on said line to the output of the water nozzle is between about 10 and 20 mm.

5. The apparatus as defined by claim 1 wherein said bulk water nozzle projects a conical-shaped spray of water.

6. The apparatus as defined by claim 1 wherein said plurality of nucleators is from 2 to 8.

7. The apparatus as defined by claim 1 wherein the air/water ratio, in terms of cubic feet per minute to gallons per minute consumed by each of said nucleators, exceeds 10.

8. Snow-making apparatus comprising the combination of (a) a housing to which sources of water and compressed air are connectable; (b) one or more bulk water nozzles mounted on said housing and each being operable to project a spray of bulk water particles into the air; and (c) one or more dedicated nucleators mounted on said housing for injecting ice particles into the spray to provide nucleation sites about which said water particles freeze and form snow particles, each of said nucleators comprising discrete air and water nozzles for respectively projecting patterns of air and water to a location external to said housing at which they mix in the ambient air and form said ice particles, said air nozzle being arranged relative to said location and said bulk water nozzle to project said ice particles to a location at which said ice particles are drawn into the spray of water particles and thereby serves as sites about which the water particles freeze to produce snow crystals, said water nozzles collectively consuming less than about 5 gallons of water per minute.

9. The apparatus as defined by claim 8 wherein said air and water nozzles of said nucleators respectively produce fan-shaped sprays of air and water which converge along a line positioned at said location.

10. The apparatus as defined by claim 8 wherein said housing has discrete air and water compartments to which sources of compressed air and water are respectively connectable.

11. The apparatus as defined by claim 8 wherein each of said bulk water nozzles produces a substantially conical spray of water particles having an average size not larger that 300 microns.

12. The apparatus as defined by claim 8 wherein a tower is provided for supporting said housing at least three meters above ground level.

13. The apparatus as defined by claim 9 wherein each of said bulk water nozzles produces a substantially flat spray of water particles having an average size not larger that 300 microns.

14. The apparatus as defined by claim 8 wherein the air/water ratio, in terms of cubic feet per minute to gallons per minute consumed by each of said nucleators, exceeds 10.

15. A method for making snow comprising the steps of: (i) projecting a bulk spray of water droplets into the ambient air, such droplets having an average size between 200 and 400 microns; (ii) producing ice nuclei by causing respective sprays of water droplets and compressed air produced by dedicated water and air nozzles to collide in the open ambient air in the vicinity of said bulk spray, such ice nuclei having an average size between 5 an 100 microns; and (iii) injecting said ice nuclei into said bulk spray of water to provide nucleation sites about which said water droplets can freeze.

16. The method as defined by claim 15 wherein the ice nuclei are produced by causing fan-shaped sprays of air and water to converge in the open air.

* * * * *